US008973384B2

(12) United States Patent
Saito

(10) Patent No.: US 8,973,384 B2
(45) Date of Patent: Mar. 10, 2015

(54) HEAT PUMP APPARATUS

(75) Inventor: Makoto Saito, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 354 days.

(21) Appl. No.: 13/320,167

(22) PCT Filed: Mar. 30, 2010

(86) PCT No.: PCT/JP2010/055686

§ 371 (c)(1),
(2), (4) Date: Nov. 11, 2011

(87) PCT Pub. No.: WO2010/137401

PCT Pub. Date: Dec. 2, 2010

(65) Prior Publication Data

US 2012/0060538 A1 Mar. 15, 2012

(30) Foreign Application Priority Data

May 26, 2009 (JP) ..... PCT/JP2009/059622

(51) Int. Cl.
*F25B 6/02* (2006.01)
*F25B 6/04* (2006.01)
(Continued)

(52) U.S. Cl.
CPC .. *F25B 6/04* (2013.01); *F24H 4/02* (2013.01); *F25B 30/02* (2013.01);
(Continued)

(58) Field of Classification Search
USPC ..... 62/197, 510, 513, 196.1–196.4
See application file for complete search history.

(56) References Cited

U.S. PATENT DOCUMENTS 4,474,018 A * 10/1984 Teagan ..... 62/79
4,787,211 A * 11/1988 Shaw ..... 62/117
(Continued)

FOREIGN PATENT DOCUMENTS

JP 59-041746 A 3/1984
JP 59-170656 A 9/1984
(Continued)

OTHER PUBLICATIONS

International Search Report (PCT/ISA/210) issued on Jun. 15, 2010, by Japanese Patent Office as the International Searching Authority for International Application No. PCT/JP2010/055686.

*Primary Examiner* — Marc Norman
*Assistant Examiner* — Max Snow
(74) *Attorney, Agent, or Firm* — Buchanan Ingersoll & Rooney PC

(57) ABSTRACT

To provide a heat pump apparatus, such as a heat pump water heating apparatus, capable of efficiently supplying high-temperature water by increasing a condensation capacity to a maximum if the outside air temperature is low. The heat pump water heating apparatus is configured to include a first refrigeration cycle and a second refrigeration cycle. The first refrigeration cycle is configured to connect in series a main compressor, a first water-refrigerant heat exchanger, an internal heat exchanger, a first pressure reducing device, and an air heat exchanger. The second refrigeration cycle diverges from the first refrigeration cycle between the first water-refrigerant heat exchanger and the first pressure reducing device, and joins the first refrigeration cycle between the main compressor and the first water-refrigerant heat exchanger. The second refrigeration cycle is configured to connect in series a second pressure reducing device, an internal heat exchanger, a sub compressor, and a third pressure reducing device.

4 Claims, 8 Drawing Sheets

(51) Int. Cl.
*F24H 4/02* (2006.01)
*F25B 30/02* (2006.01)
*F28D 9/00* (2006.01)

(52) U.S. Cl.
CPC .... *F25B 2339/047* (2013.01); *F25B 2400/075* (2013.01); *F25B 2400/13* (2013.01); *F25B 2500/31* (2013.01); *F28D 9/005* (2013.01)
USPC ..... 62/196.1; 62/199; 62/510; 62/513

(56) References Cited

U.S. PATENT DOCUMENTS

| | | | | |
|---|---|---|---|---|
| 4,947,655 | A * | 8/1990 | Shaw | 62/200 |
| 6,276,148 | B1 * | 8/2001 | Shaw | 62/117 |
| 6,321,564 | B1 | 11/2001 | Yamanaka et al. | |
| 6,442,951 | B1 * | 9/2002 | Maeda et al. | 62/94 |
| 6,880,357 | B2 * | 4/2005 | Nakatani et al. | 62/324.6 |
| 7,131,285 | B2 * | 11/2006 | Lifson et al. | 62/196.4 |
| 7,155,920 | B2 * | 1/2007 | Lifson et al. | 62/175 |
| 7,257,958 | B2 * | 8/2007 | Bush et al. | 62/199 |
| 8,181,478 | B2 * | 5/2012 | Ignatiev | 62/468 |
| 2001/0037653 | A1 * | 11/2001 | Yamanaka et al. | 62/210 |
| 2002/0026806 | A1 * | 3/2002 | Tsuboe et al. | 62/505 |
| 2003/0033823 | A1 * | 2/2003 | Pham et al. | 62/228.3 |
| 2003/0121276 | A1 * | 7/2003 | Maeda | 62/271 |
| 2004/0031278 | A1 * | 2/2004 | Martin | 62/201 |
| 2004/0144528 | A1 * | 7/2004 | Kunimoto et al. | 165/298 |
| 2006/0191288 | A1 * | 8/2006 | Radermacher et al. | 62/510 |
| 2006/0266074 | A1 * | 11/2006 | Groll et al. | 62/510 |
| 2007/0017240 | A1 * | 1/2007 | Shapiro | 62/228.1 |
| 2007/0113583 | A1 * | 5/2007 | Chung | 62/505 |
| 2007/0163297 | A1 * | 7/2007 | Zhang et al. | 62/527 |
| 2007/0186581 | A1 * | 8/2007 | Mistry et al. | 62/505 |
| 2008/0022710 | A1 * | 1/2008 | Jeong et al. | 62/324.6 |
| 2008/0196874 | A1 * | 8/2008 | Bertilsson et al. | 165/167 |
| 2009/0007591 | A1 * | 1/2009 | Bean et al. | 62/513 |
| 2009/0175748 | A1 * | 7/2009 | Bush et al. | 418/5 |
| 2009/0188277 | A1 * | 7/2009 | Chantant et al. | 62/612 |
| 2009/0282849 | A1 * | 11/2009 | Fujimoto et al. | 62/228.5 |
| 2010/0199715 | A1 * | 8/2010 | Lifson et al. | 62/510 |
| 2010/0223939 | A1 * | 9/2010 | Mitra et al. | 62/117 |
| 2010/0326100 | A1 * | 12/2010 | Taras et al. | 62/115 |

FOREIGN PATENT DOCUMENTS

| | | | |
|---|---|---|---|
| JP | 60-226669 | A | 11/1985 |
| JP | 62-266364 | A | 11/1987 |
| JP | 4-263758 | A | 9/1992 |
| JP | 5-099534 | A | 4/1993 |
| JP | 11-270919 | A | 10/1999 |
| JP | 2000-329416 | A | 11/2000 |
| JP | 2001-330332 | A | 11/2001 |
| JP | 2005-061784 | A | 3/2005 |
| JP | 2005-147456 | A | 6/2005 |
| WO | WO 2007/142619 | A2 | 12/2007 |

* cited by examiner

TEMPERATURE CHANGES IN WATER-REFRUGERABT HEAT EXCHANGER

HEAT PUMP APPARATUS

TECHNICAL FIELD

The present invention relates to a heat pump apparatus such as a heat pump water heating apparatus, and more particularly to a heat pump apparatus capable of achieving a high heating capacity and efficiently supplying water at high temperature if the outside air temperature is low.

BACKGROUND ART

Among methods of obtaining a sufficient condensation heat even if the outside air temperature is low, a method of increasing a refrigeration capacity by heat recovery is known (e.g., see Patent Document 1). This method is implemented in a configuration including a main refrigerant circuit and a sub refrigerant circuit equipped with a second compressor, wherein the sub circuit recovers heat from the main circuit via an internal heat exchanger.

Among methods of efficiently supplying high-temperature water, a method of increasing water temperature by a two-stage compression cycle configuration (e.g., see the Patent Document 2). This method is implemented by letting water flow through a lower stage condenser and a higher stage condenser arranged in series.

RELATED ART DOCUMENTS

Patent Documents

[Patent Document 1] JP 59-41746 A
[Patent Document 2] JP 4-263758 A

SUMMARY OF INVENTION

Technical Problem

Referring further to Patent Document 1, the configuration poses a problem in that an overall efficiency of the refrigeration cycle is reduced by a high compression ratio in response to a demand for supplying high temperature water. In addition to that, the maximum evaporation heat of the sub refrigerant circuit is limited to the amount of heat that the sub refrigerant circuit can recover from a high pressure liquid refrigerant flowing through the main circuit. Thus, there is a limit to an addable amount of condensation heat to the main circuit side (=second compressor input+the evaporation heat mentioned).

Referring further to Patent Document 2, because the refrigerant enthalpy at the entrance of an outdoor heat exchanger as an evaporator does not change depending on whether the higher stage compressor is operated or stopped, the amount of heat that can be absorbed from the outside air is determined by a maximum capacity of the lower stage compressor. Therefore, all the heat from the electricity input of the higher stage compressor is used as the condensation capacity. That means that the heating performance of the higher stage cycle is equal to that of an electric heater, and thus the heating efficiency can hardly be said to be high.

The present invention is designed to solve such problems as those described above. It is an objective to provide a heat pump apparatus capable of efficiently heating and supplying water at high temperature by increasing a condensation capacity up to a maximum if the outside air temperature is low.

Solution to Problem

A heat pump apparatus according to this invention is characterized by including a first refrigeration cycle and a second refrigeration cycle, which may diverge from the first refrigeration cycle between the first heat exchanger and the first pressure reducing device, and join the first refrigeration cycle between the first compressor and the first heat exchanger. The first refrigeration cycle may be configured to connect in series a first compressor, a first heat exchanger, an internal heat exchanger, a first pressure reducing device, and an evaporator, and the second refrigeration cycle may be configured to connect in series a second pressure reducing device, the internal heat exchanger, a second compressor, and a third pressure reducing device.

The heat pump apparatus is characterized in that the second refrigeration cycle may further include a radiation means that may be placed between the second compressor and the third pressure reducing device.

The heat pump apparatus is characterized in that the radiation means operates as a second heat exchanger, and is arranged so that heat is exchanged between a fluid and a refrigerant flowing through the first refrigeration cycle in the first heat exchanger, and then heat is exchanged between the fluid and a refrigerant flowing through the second refrigeration cycle in the second heat exchanger.

The heat pump apparatus is characterized by further including a controller adjusting the opening of the third pressure reducing device so that a condensation pressure of the second heat exchanger is higher than a condensation pressure of the first heat exchanger.

The heat pump apparatus is characterized in that the controller controls the second compressor so that an evaporation pressure of the second refrigeration cycle is higher than an evaporation pressure of the first refrigeration cycle.

The heat pump apparatus is characterized in that the first heat exchanger may be a water-refrigerant heat exchanger for exchanging heat between water and the refrigerant flowing through the first refrigeration cycle, and the second heat exchanger may be a water-refrigerant heat exchanger for exchanging heat between water and the refrigerant flowing through the second refrigeration cycle.

The heat pump apparatus is characterized in that at least one of the first heat exchanger and the second heat exchanger may be a plate heat exchanger.

The heat pump apparatus is characterized in that the radiation means may include a pipe disposed in a vicinity of a lower end of the evaporator.

The heat pump apparatus is characterized in that the second refrigeration cycle may further include:

a plurality of radiation means that may be arranged in parallel between the second compressor and the third pressure reducing device, and a radiation means switching device for switching between the plurality of radiation means to allow the refrigerant flowing through the second refrigeration circuit to flow through one of the radiation means.

Advantageous Effect of Invention

A heat pump apparatus according to this invention is designed to increase an enthalpy difference at an evaporator by a heat recovery operation carried out by a second compressor and an internal heat exchanger without the use of an injection compressor which is costly. This may allow for a large heating capacity which is more than the heating capacity that could be obtained by the electricity input of the second compressor alone. In addition to that, the amount of heat absorbed from the outside air is increased. This may allow for a water heating operation with a COP that is higher than the COP of an electric heater increasing the heating capacity.

In addition to the above, the discharge pressure of the second compressor can be adjusted arbitrarily by a third pressure reducing means. This may allow for a maxim heating capacity if the electricity input of the second compressor is adjusted to a maximum.

In addition to the above, a total amount of refrigerant flowing from a first compressor and the second compressor enters a first heat exchanger, which accelerates the flow speed of refrigerant in the first heat exchanger. This may allow for an improvement in the refrigerant side heat transfer performance inside the first heat exchanger. This is particularly effective with a plate heat exchanger used as the first heat exchanger.

In addition to the above, a second heat exchanger is provided between the second compressor and the third pressure reducing device to obtain different condensation temperatures in the first refrigeration cycle and the second refrigeration cycle so as to heat a fluid such as water through two stages. This may allow for a highly efficient heating operation in response to a demand for high-temperature water or the like.

DESCRIPTION OF EMBODIMENT

Embodiment 1

Figure 1:
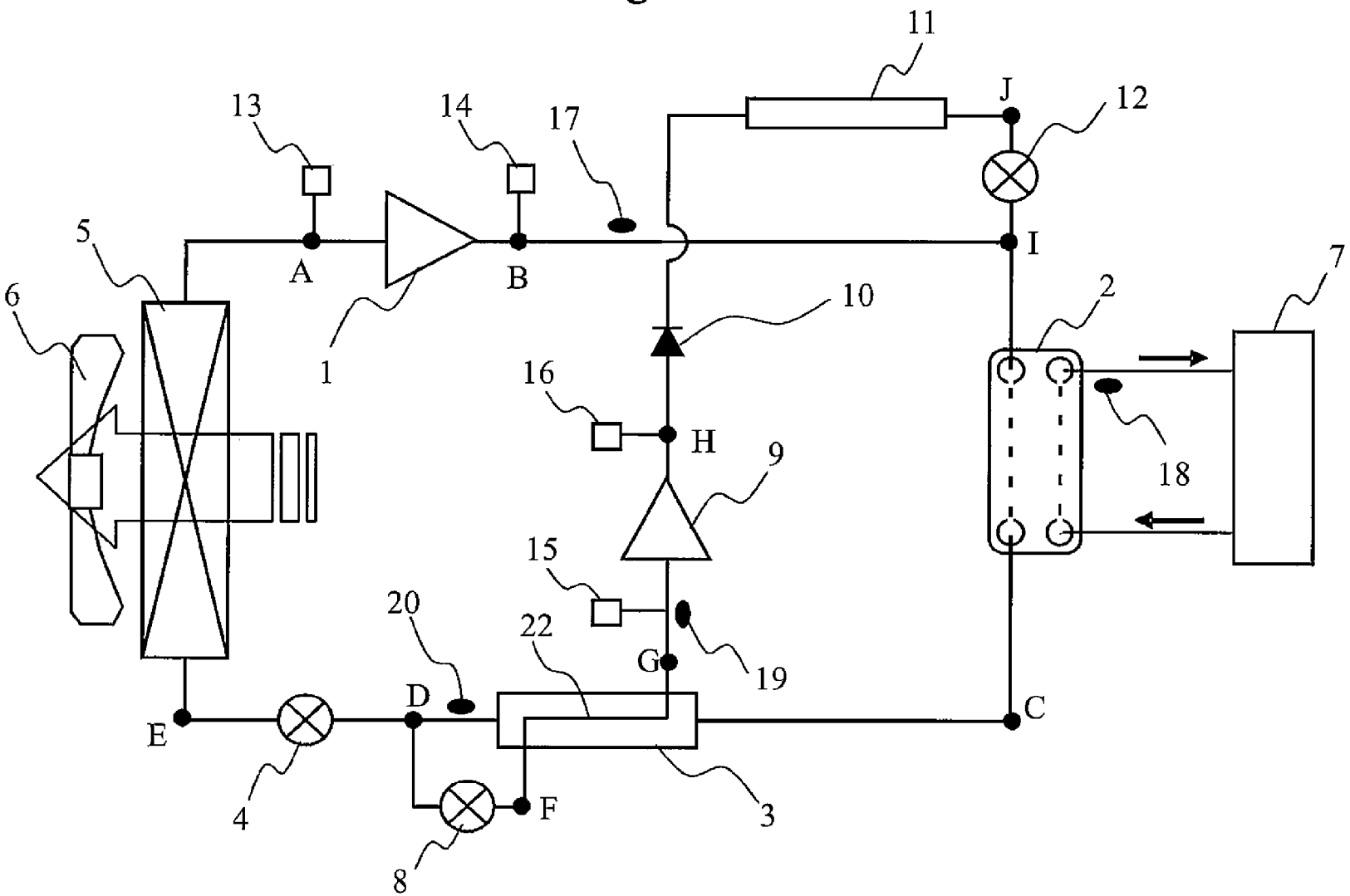
FIG. 1 shows a refrigerant circuit of a heat pump water heating apparatus according to a first embodiment.
Figure 2:
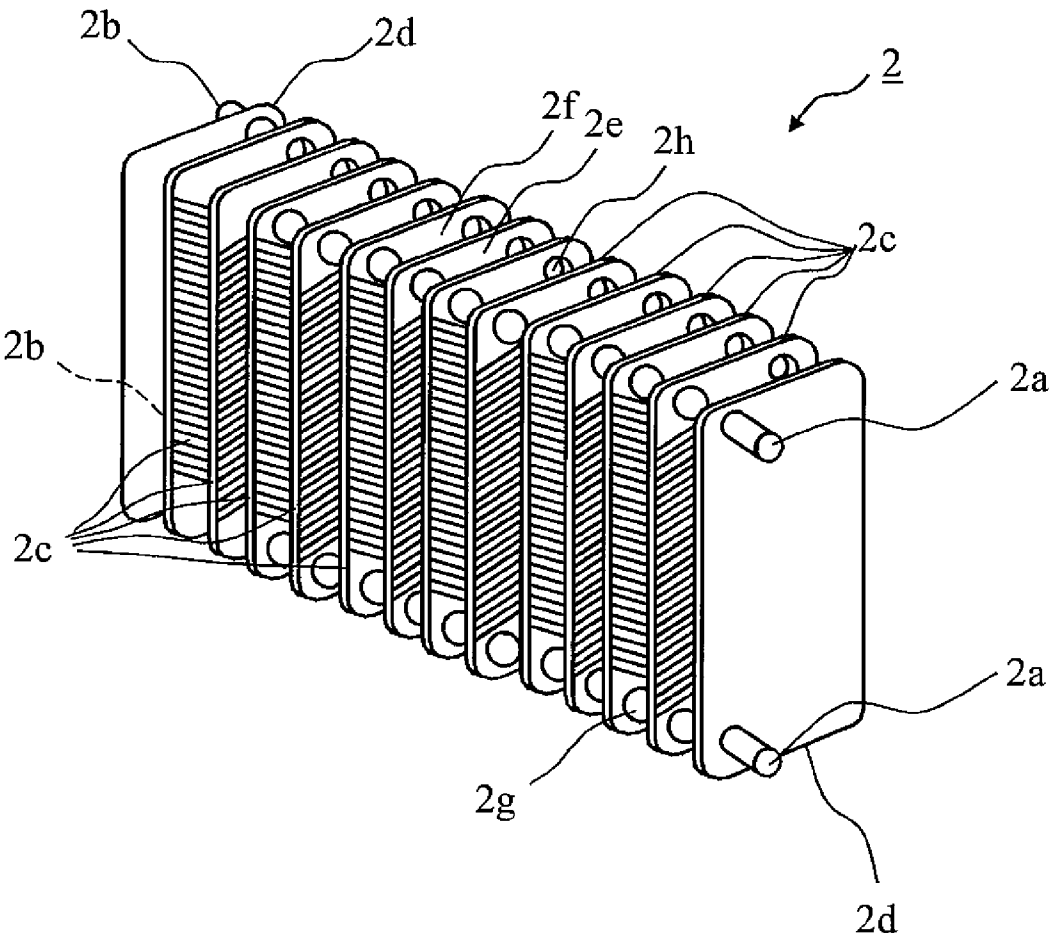
FIG. 2 is a perspective view of a first water-refrigerant heat exchanger 2 (a plate heat exchanger) illustrating an internal configuration thereof, according to the first embodiment.
Figure 3:
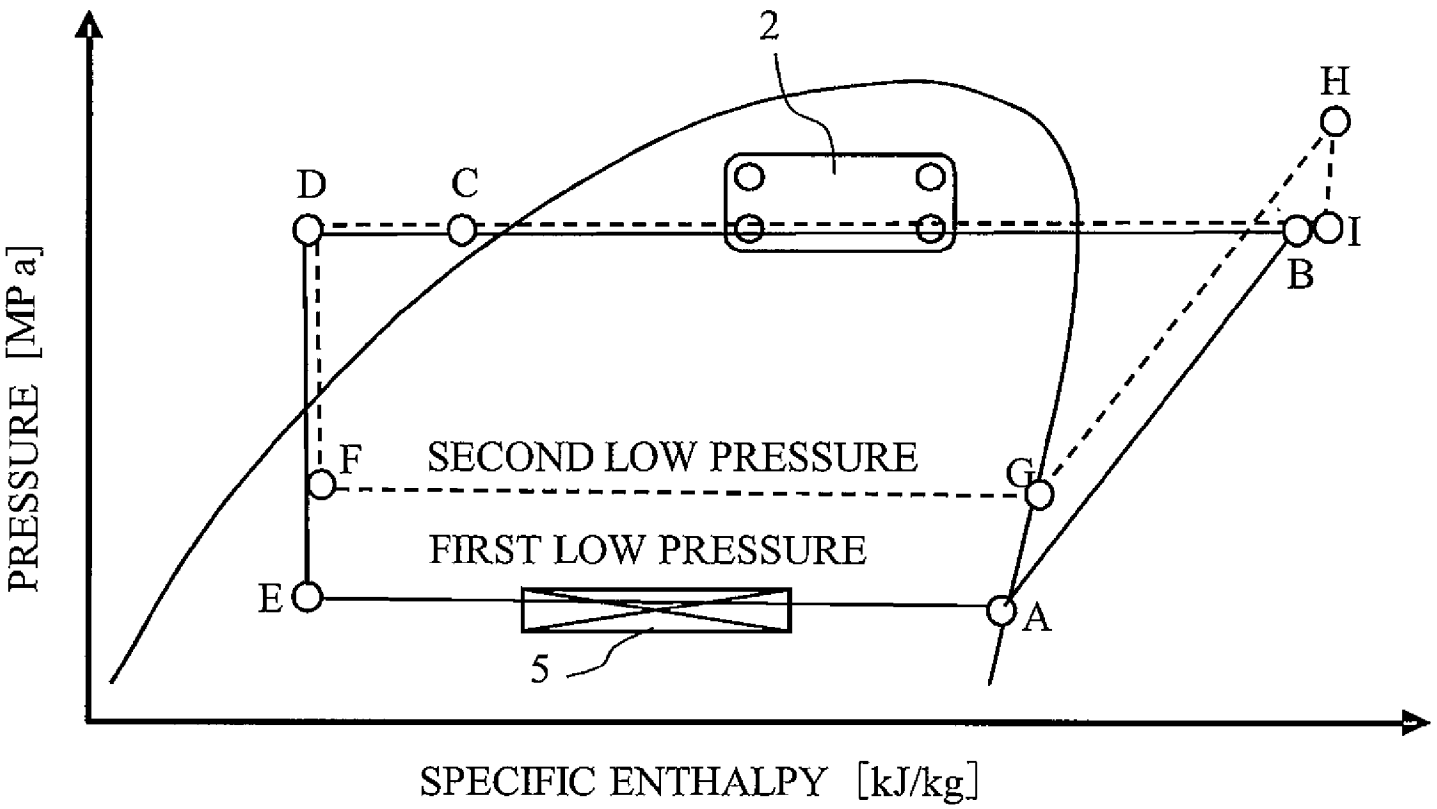
FIG. 3 is a P-h diagram illustrating an operation of a refrigeration cycle, according to the first embodiment.
Figure 4:
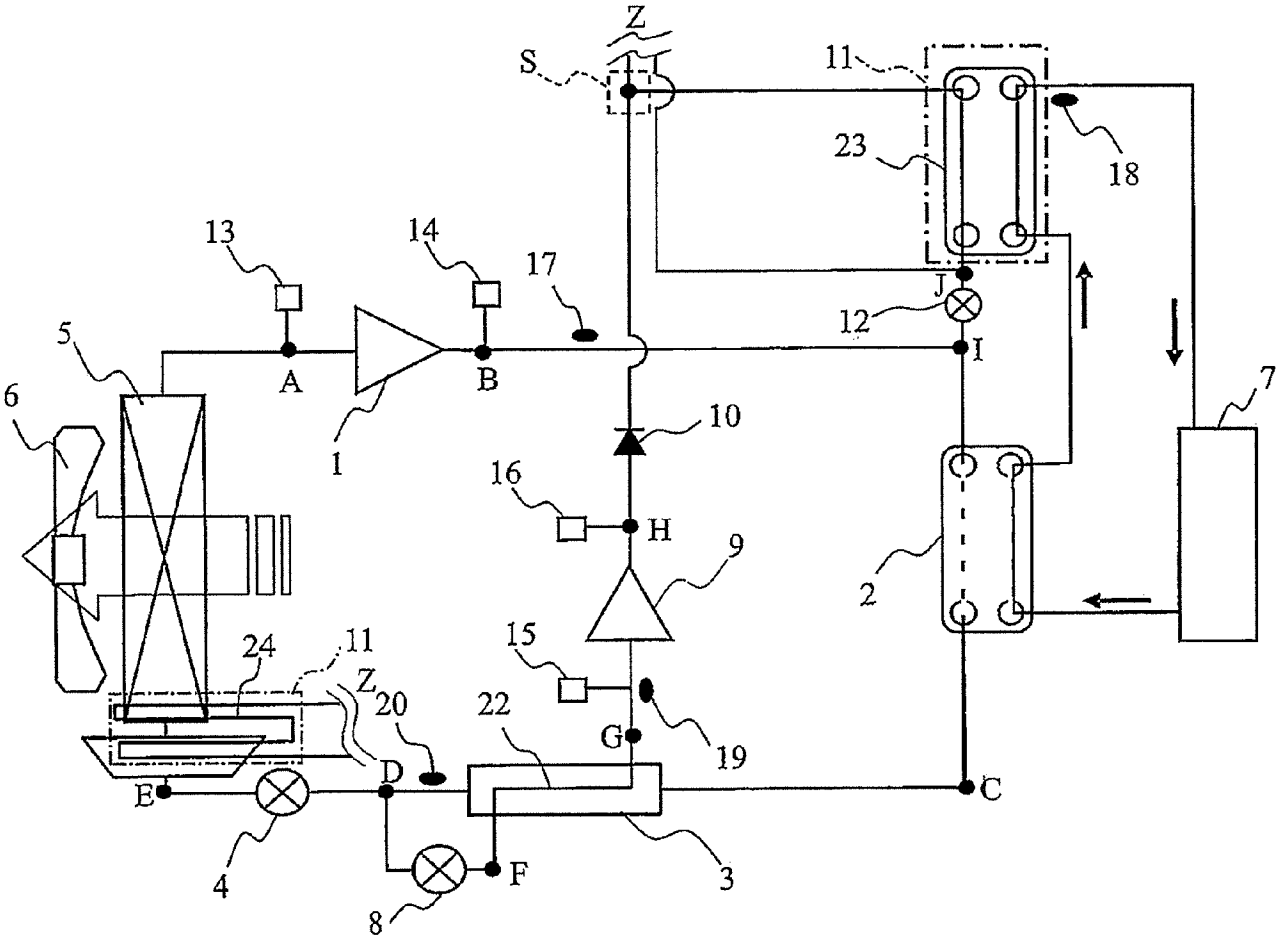
FIG. 4 shows a refrigerant circuit of a heat pump water heating apparatus when a radiation means is a water-refrigerant heat exchanger, according to the first embodiment.
Figure 5:
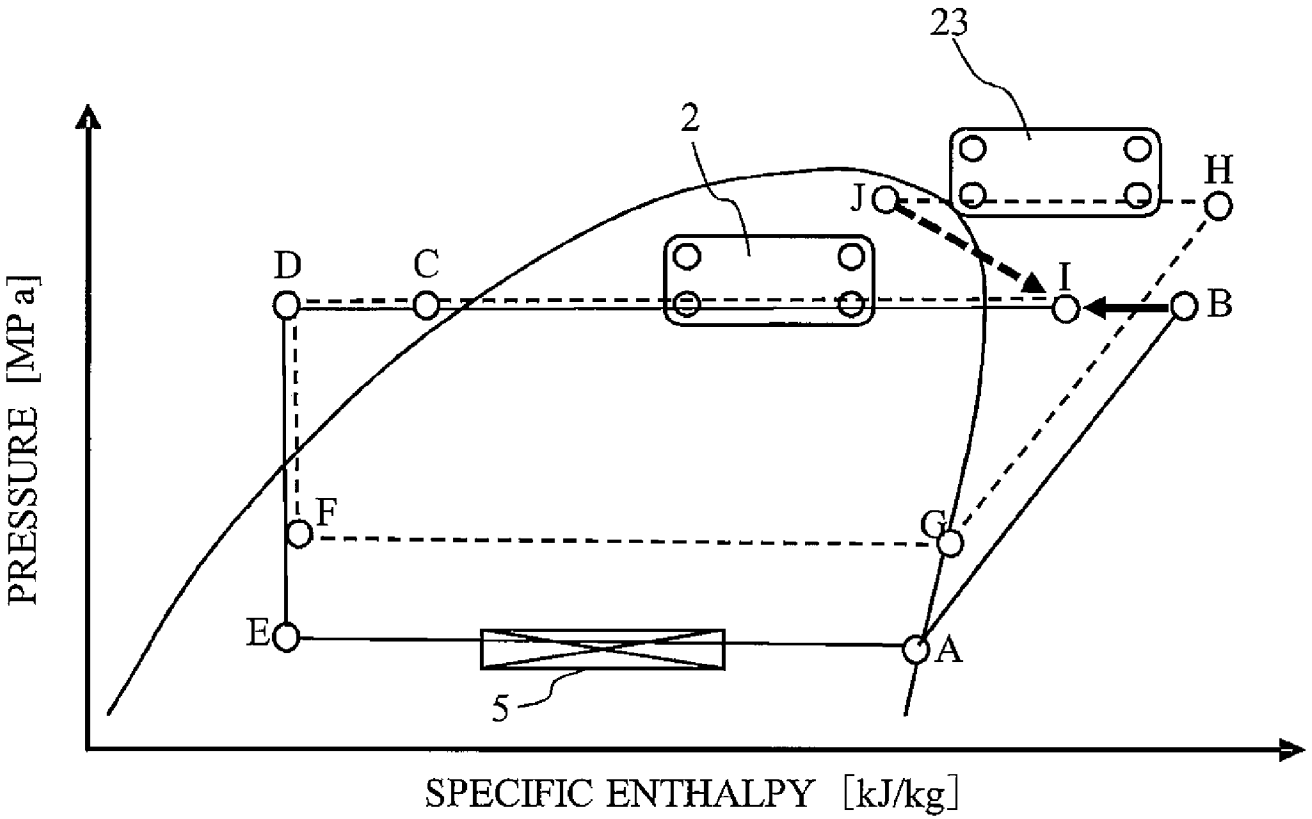
FIG. 5 is a P-h diagram illustrating a refrigeration cycle operation when the radiation means is the water-refrigerant heat exchanger, according to the first embodiment.
Figure 6:
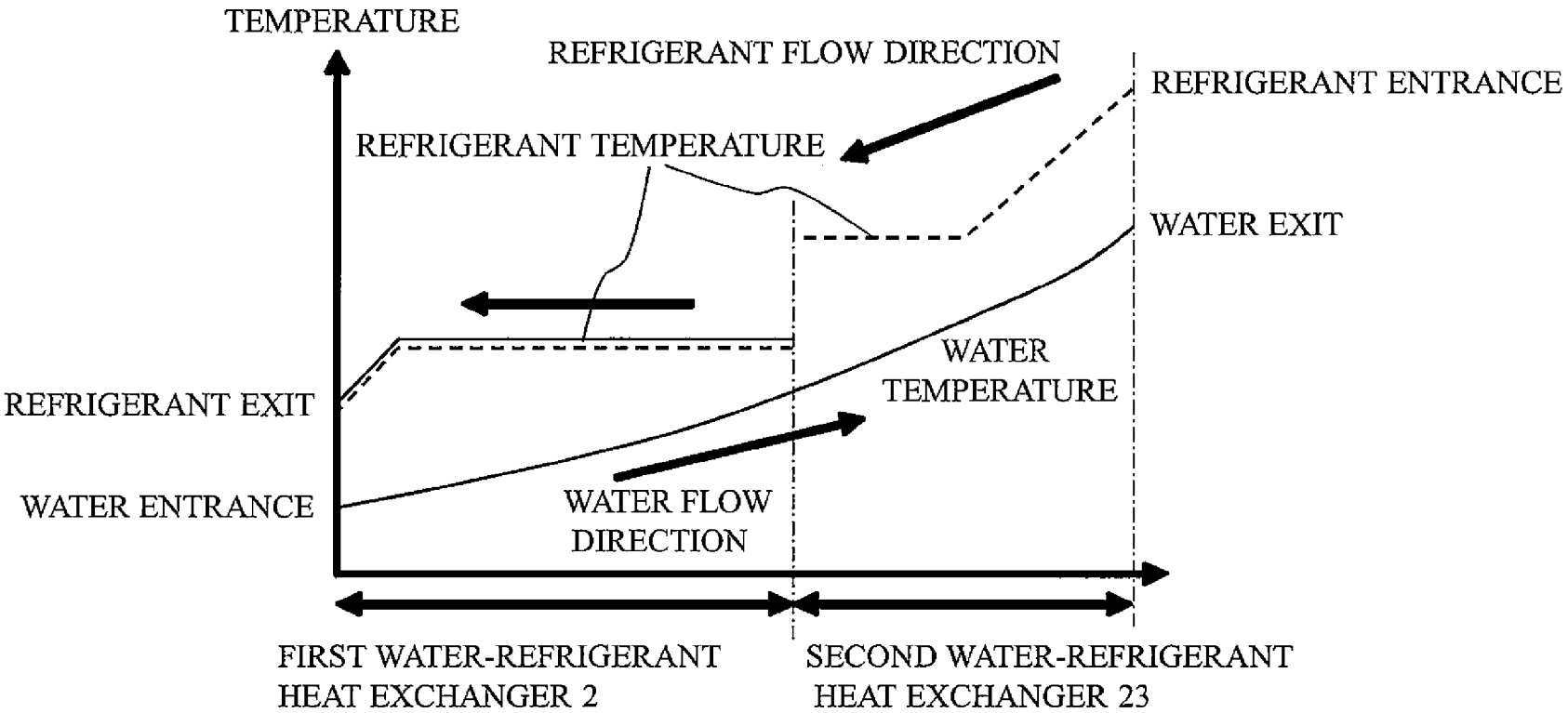
FIG. 6 shows temperature changes at water-refrigerant heat exchangers when the radiation means is the water-refrigerant heat exchanger, according to the first embodiment.
Figure 7:
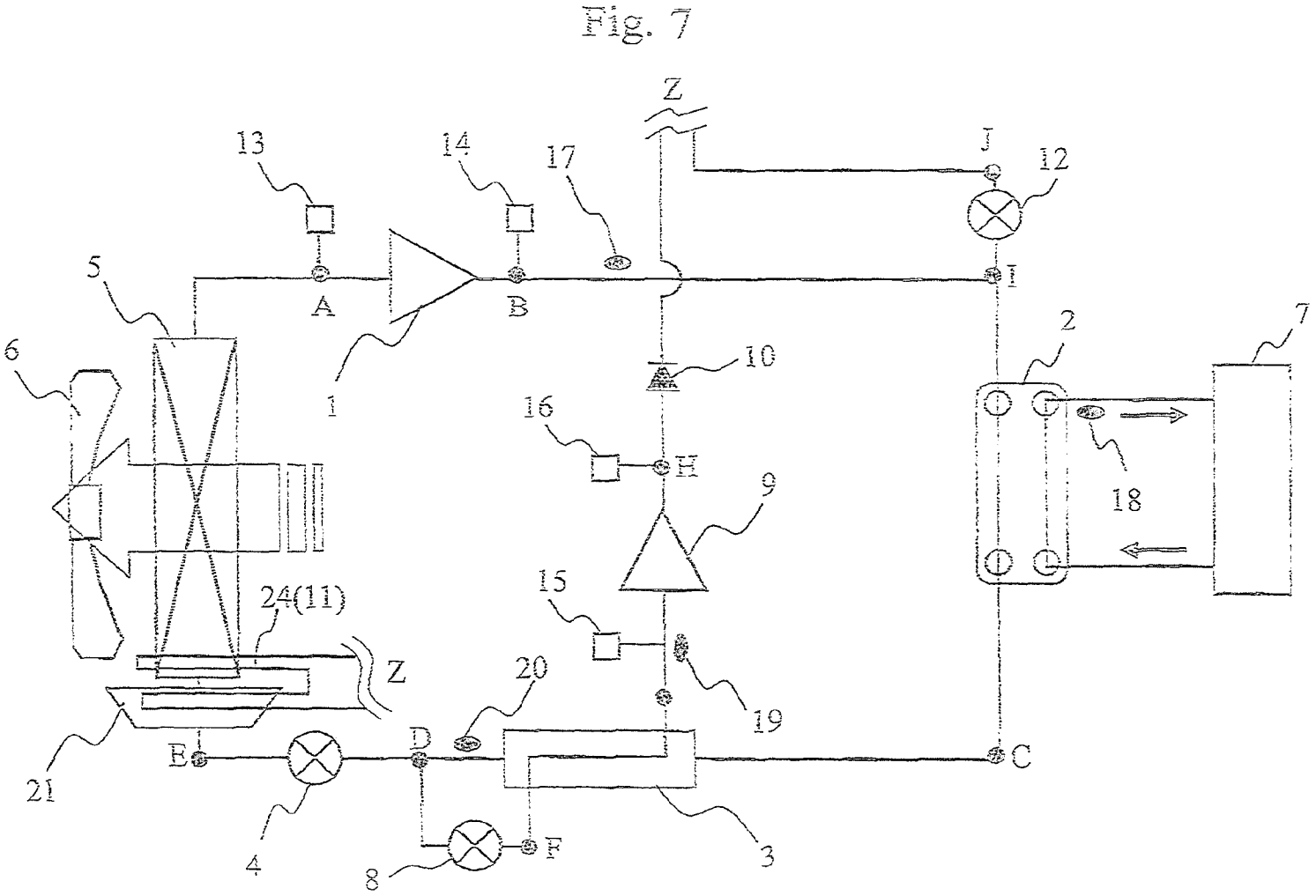
FIG. 7 shows a configuration of a refrigerant circuit when the radiation means is an antifreeze heater, according to the first embodiment.
Figure 8:
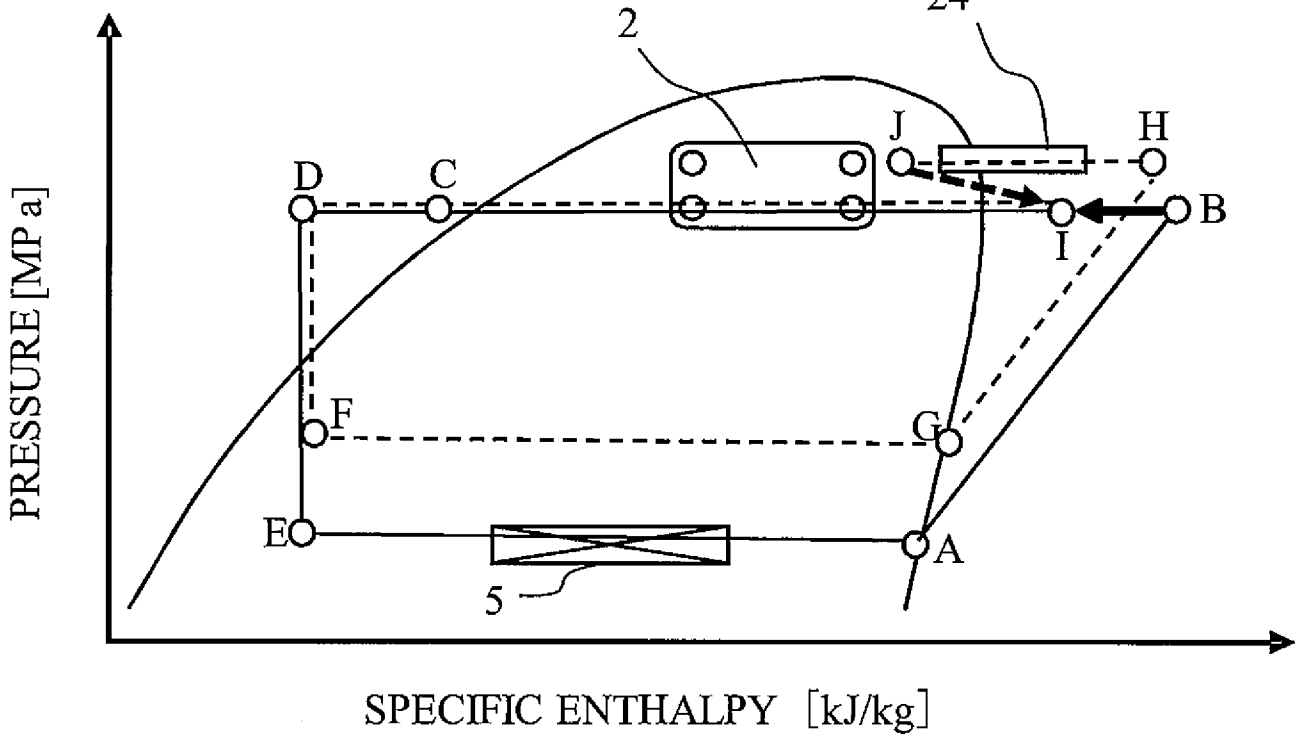
FIG. 8 is a P-h diagram illustrating a refrigeration cycle operation when the radiation means is the antifreeze heater, according to the first embodiment.

FIG. 1 to FIG. 7 illustrate a first embodiment. FIG. 1 shows a refrigerant circuit of a heat pump water heating apparatus. FIG. 2 is a perspective view of a first water-refrigerant heat exchanger 2 (a plate heat exchanger) illustrating an internal configuration thereof. FIG. 3 is a P-h diagram illustrating an operation of a refrigeration cycle. FIG. 4 illustrates a refrigerant circuit of a heat pump water heating apparatus when a radiation means is a water-refrigerant heat exchanger. FIG. 5 is a P-h diagram illustrating a refrigeration cycle operation when the radiation means is the water-refrigerant heat exchanger. FIG. 6 illustrates temperature changes at water-refrigerant heat exchangers when the radiation means is the water-refrigerant heat exchanger. FIG. 7 illustrates a configuration of a refrigerant circuit when the radiation means is an antifreeze heater. FIG. 8 is a P-h diagram illustrating a refrigeration cycle operation when the radiation means is the antifreeze heater.

A description is given of an example of a refrigerant circuit in a heat pump water heating apparatus with reference to FIG. 1. The refrigerant circuit in a heat pump water heating apparatus of FIG. 1 includes a first refrigeration cycle and a second refrigeration cycle.

The first refrigeration cycle is configured to connect in series a main compressor 1 (a first compressor), a first water-refrigerant heat exchanger 2 (a first heat exchanger), an internal heat exchanger 3, a motorized expansion valve 4 (a first pressure reducing device), and an air heat exchanger 5 (an evaporator) for absorbing heat from the outside air.

The second refrigeration cycle diverges from the first refrigeration cycle between the internal heat exchanger 3 and the motorized expansion valve 4, and joins the first refrigeration cycle between the main compressor 1 and the first water-refrigerant heat exchanger 2. Alternatively, however, the second refrigeration circuit may diverge at any point between the first water-refrigerant heat exchanger 2 and the motorized expansion valve 4.

The second refrigeration cycle is configured to connect in series a flow divider expansion valve 8 (a second pressure reducing device), a suction pipe 22 (which runs through the internal heat exchanger 3) of a sub compressor 9 (a second compressor), the sub compressor 9, a check valve 10, a sub radiation means 11 (a radiation means) and a junction expansion valve 12 (a third pressure reducing device) after thus diverging from the first refrigeration cycle between the internal heat exchanger 3 and the motorized expansion valve 4 and before thus joining the first refrigeration cycle between the main compressor and the first water-refrigerant heat exchanger 2.

The first refrigeration cycle and the second refrigeration cycle may be charged with R410A refrigerant, for example.

The main compressor 1 is equipped with a pressure sensor 13 for detecting a suction pressure and a pressure sensor 14 for detecting a discharge pressure. The sub compressor 9 is equipped with a pressure sensor 15 for detecting a suction pressure and a pressure sensor 16 for detecting a discharge pressure.

A temperature sensor 17 for detecting a discharge temperature of a refrigerant at the main compressor 1, a temperature sensor 18 for detecting a supply water temperature at an exit of the first water-refrigerant heat exchanger 2, a temperature sensor 19 for detecting the temperature of the refrigerant to be sucked in by the sub compressor 9, and a temperature sensor 20 for detecting the temperature of the refrigerant at an exit of the internal heat exchanger 3 in the first refrigeration cycle.

Based on information detected by the pressure sensors 13 to 16, and the temperature sensors 17 to 20, a controller not shown controls the operation of the heat pump water heating apparatus.

The controller is configured with a microcomputer with predetermined built-in programs, and performs various control operations described below. It is to be noted, however, that the description below is given without mentioning the "controller".

The air heat exchanger 5 is equipped with a fan 6 to adjust an amount of heat to be absorbed from the outside air.

The first water-refrigerant heat exchanger 2 is connected to a hot water tank 7 as a water heating load, and water as a heating medium circulates through the first water-refrigerant heat exchanger 2. Arrows shown in FIG. 1 indicate flows of water as a heating medium.

The first water-refrigerant heat exchanger 2 is implemented by using an existing plate heat exchanger. A brief description is now given of an internal configuration of the first water-refrigerant heat exchanger 2 (a plate heat exchanger) with reference to FIG. 2. It is to be noted that a cylindrical casing as an outer cover is omitted in FIG. 2. The first water-refrigerant heat exchanger 2 (a plate heat exchanger) is configured to have a refrigerant pipe connecting port 2*a* on one of outermost end plates 2*d*, and a water pipe connecting port 2*b* on the other outmost end plate 2*d*.

Between the pair of outermost end plates 2*d* is a plurality of corrugated heat transfer plates 2*c* arranged in parallel. There are alternately arranged refrigerant flow channels 2*e* and water flow channels 2*f* between each heat transfer plate 2*c*. The heat transfer plates 2*c* are formed to have holes 2*g* for refrigerant passage for connecting the refrigerant flow channels 2*e* and the refrigerant pipe connecting port 2*a*. The heat transfer plates 2*c* are also formed to have holes 2*h* for water passage for connecting the water channels 2*f* and the water pipe connecting port 2*b*.

A description is now given of an operation of the heat pump water heating apparatus thus configured of the first embodiment.

An operation of a refrigeration cycle in water heating is described first when the sub radiation means 11 has nothing connected thereto with reference to FIG. 1 and FIG. 3.

FIG. 3 is a P-h diagram (also called a Mollier diagram) illustrating an operation of a refrigeration cycle in water heating where the horizontal axis indicates specific enthalpy [kJ/kg] and the vertical axis indicates refrigerant pressure [MPa].

Referring to FIG. 3, the first refrigeration cycle operates as indicated by a solid line connecting points A, B, C, D, E, and A in series. The second refrigeration cycle operates as indicated by a dotted line connecting points G, H, I, C, D, F, and G in series.

The following are a series of operations carried out in the first refrigeration cycle:

(1) a low pressure gas refrigerant (state A) is sucked in by the main compressor 1;

(2) the low pressure gas refrigerant (state A) is compressed in the main compressor 1 into a high temperature, high pressure gas refrigerant (state B), and discharged as a high temperature, high pressure gas refrigerant (state B);

(3) the high temperature, high pressure gas refrigerant (state B) condenses into a high pressure liquid refrigerant (state C) in the first water-refrigerant heat exchanger 2 as a result of heat transfer into water;

(4) the high pressure liquid refrigerant (state C) turns into a sub-cooled liquid refrigerant (state D) as a result of heat exchange with a divergent refrigerant of the second refrigeration cycle in the internal heat exchanger 3;

(5) the sub-cooled liquid refrigerant (state D) turns into a two-phase low pressure refrigerant (state E) in the motorized expansion valve 4 where pressure is reduced to a first low pressure; and (6) the two-phase low pressure refrigerant (state E) absorbs heat from the outside air to vaporize in the air heat exchanger 5, and turns into the low pressure gas refrigerant again (state A).

The opening of the motorized expansion valve 4 is adjusted so that an actual discharge temperature detected by the temperature sensor 17 agrees with a target discharge temperature at which a refrigerant to be sucked in by the main compressor 1 (state A) is a saturated vapor. The target temperature is predicted based on information about a previously given operating characteristic of the main compressor 1, a suction pressure detected by the pressure sensor 13, and a discharge pressure detected by the pressure sensor 14.

The rotational speed (an operational capacity) of the main compressor 1 is also adjusted so that the supply water temperature detected by the temperature sensor 18 has a target value, e.g., 45° C. The operation described allows water to be heated to a predetermined temperature for supply to the hot water tank 7 as a hot water load.

When the outside air temperature is extremely low or a demanded heating capacity is large, however, if the main compressor 1 operates at full capacity, the water temperature may not be adjusted to a target supply water temperature (e.g., 45° C.).

As an example, a scroll compressor of about 5 horsepower may be used as the main compressor 1, and a rotary compressor of about 2 horsepower may be used as the sub compressor 9.

In such a case, the second refrigeration cycle is to be operated. Referring to the second refrigeration cycle, part of the refrigerant flowing through the internal heat exchanger 3 diverges at the exit of the internal heat exchanger 3 (state D) and then flows through the flow divider expansion valve 8 where pressure is reduced to a second low pressure (which is higher than the first low pressure). The refrigerant at the second low pressure (state F) flows through a suction pipe 22 running through the internal heat exchanger 3, thereby absorbing heat from the high pressure liquid refrigerant (state C) to turn into the gas refrigerant (state G). The gas refrigerant (state G) is then sucked in by the sub compressor 9, where pressure is increased, and turns into a second high pressure gas refrigerant (state H). The second high pressure gas refrigerant (state H) flows through the junction expansion valve 12, where pressure is reduced, and joins the flow of refrigerant (state B) discharged from the main compressor 1. The combined flow of refrigerant (state I) enters the first water-refrigerant heat exchanger 2. Thereafter, in the first water-refrigerant heat exchanger 2, the gas refrigerant (state I) transfers heat to water and condenses into the high pressure liquid refrigerant (state C). Then, in the internal heat exchanger 3, the high pressure liquid refrigerant (state C) exchanges heat with the divergent refrigerant of the second refrigeration cycle, thereby turning into the subcooled liquid (state D).

The opening of the flow divider expansion valve 8 is adjusted so that the refrigerant (state G) to be sucked in by the sub compressor 9 is a saturated vapor, or slightly superheated when detected by the temperature sensor 19 and the pressure sensor 15 (state G).

The sub compressor 9 may be a constant speed compressor, but if an inverter driven compressor whose rotational speed is adjustable is used instead, then the rotational speed of the sub compressor 9 is adjusted so that the suction pressure detected by the pressure sensor 15 has a predetermined value.

The opening of the junction expansion valve 12 can control the discharge pressure of the sub compressor 9 detected by the pressure sensor 16. Therefore, the opening of the junction expansion valve 12 is adjusted so that the electricity input of the sub compressor 9 can have a discharge pressure at which a demanded heating capacity can be obtained.

The heat pump water heating apparatus of the first embodiment is thus configured to operate the second refrigeration cycle in order to maximize the heating capacity. This allows the high pressure liquid refrigerant (state C), which is resulted from condensation by heat transfer to water in the first water-refrigerant heat exchanger 2, to turn into the subcooled liquid (state D) as a result of heat exchange with the divergent refrigerant of the second refrigeration cycle in the internal heat exchanger 3. This allows the difference between the state E and the state A to be increased, thereby increasing an amount of heat absorbed from the outside air. Hence, the operational efficiency of a heating operation is improved.

In addition to that, the total amount of condensation heat of the heat pump water heating apparatus can thus include heat from the electricity input of the sub compressor 9 in addition to heat absorbed from the outside air and heat from the electricity input of the main compressor 1. This allows for an increase in the maximum heating capacity of the heat pump water heating apparatus.

A description is now given of when the sub radiation means 11 is used as a second water-refrigerant heat exchanger 23 (a second heat exchanger) with reference to FIG. 4 to FIG. 6.

An operation of a refrigeration cycle and the control thereof are basically similar to those described with reference to when the sub radiation means 11 has nothing connected to it. Here, however, the second water-refrigerant heat exchanger 23 is employed as the sub radiation means 11, and cyclic water from the hot water tank 7 flows through the first water-refrigerant heat exchanger 2 of the first refrigeration cycle and the second water-refrigerant heat exchanger 23 of the second refrigeration cycle.

The high temperature, high pressure gas refrigerant (state H) discharged from the sub compressor 9 enters the second water-refrigerant heat exchanger 23 where heat is transferred to water again. Hotter cyclic water then returns to the hot water tank 7. The refrigerant (state J) exits the second water-refrigerant heat exchanger 23 and flows through the junction expansion valve 12 where pressure is reduced. Then, the refrigerant joins the flow of the discharged refrigerant (state B) from the main compressor 1, and the combined flow of refrigerant then enters the first water-refrigerant heat exchanger 2 (state I).

The second refrigeration cycle is put in action when the main compressor 1 has been working at full capacity. With the junction expansion valve 12, the opening is adjusted so that the discharge pressure of the sub compressor 9 agrees with a target discharge pressure. The target discharge pressure is set to allow water to be supplied at a demanded temperature in response to a demand for high-temperature water as hot as or hotter than 50° C., for example. With the sub compressor 9, the rotational speed is adjusted to obtain a heating capacity capable of supplying water at a target supply temperature detected by the temperature sensor 18.

In addition to the above, the discharge pressure (an output value of the pressure sensor 16) of the sub compressor 9 is almost determined by the temperature of water entering the second water-refrigerant heat exchanger 23 from the first water-refrigerant heat exchanger 2. Given this fact, the opening of the junction expansion valve 12 may be adjusted so that a degree of subcooling of refrigerant (state J) is between 1 [k] to 2 [k] at the exit of the second water-refrigerant heat exchanger 23. With this case, the suction pressure (an output value of the pressure sensor 15) and the electricity input of the sub compressor 9 vary depending on the rotational speed of the sub compressor 9. The heating capacity of the second water-refrigerant heat exchanger 23 also varies depending on the rotational speed of the sub compressor 9 accordingly. This opening adjustment can therefore adjust the exit water temperature to a set value.

FIG. 6 shows temperature changes of water and refrigerant inside the first water-refrigerant heat exchanger 2 and the second water-refrigerant heat exchanger 23. On the cyclic water side, water flows through the first water-refrigerant heat exchanger 2 and the second water-refrigerant heat exchanger 23, which are arranged in series, thereby increasing the water temperature almost linearly from the entrance to the exit.

On the refrigerant side, the condensation pressure of the second water-refrigerant heat exchanger 23 is set higher than that of the first water-refrigerant heat exchanger 2, thereby producing different condensation temperatures. This can make the difference of the refrigerant temperature from the water temperature, which is rising, smaller than when water is heated by using a uniform condensation temperature.

More specifically, water can be heated by using a lower condensation temperature on the side where the water temperature is lower, and by a higher condensation temperature on the side where the water temperature is higher. This can prevent the difference between the water temperature and the refrigerant temperature from increasing unnecessarily. Thus, the supply water can be heated highly efficiently at a uniform temperature. This allows for an improvement in the coefficient of performance (COP) of the refrigeration cycles.

Especially with a demand for water as hot as or hotter than 50° C., the condensation temperature should be set to a temperature higher than a demanded temperature. The refrigerant circuit shown in FIG. 4, however, in which the second water-refrigerant heat exchanger 23 operates as the sub radiation means 11, requires such a high condensation temperature only at the second water-refrigerant heat exchanger 23 side, that is, at the second refrigeration cycle side. This allows for a highly efficient overall system operation. In addition to that, there is no need to absorb heat from the outside air in the second refrigerant cycle. This allows the operation to be performed with a relatively high pressure at the low pressure side in the second refrigerant cycle. This rarely results in a high compression ratio if the outside air is extremely low, and thereby rarely causes operational restrictions by an abnormal rise in the discharge temperature or the like. More specifically, the low pressure of the second refrigeration cycle is adjusted so that the pressure level is higher than that of the low pressure of the first refrigeration cycle. This can contribute to enhance reliability in severe operating conditions.

The refrigerant circulated by the main compressor 1 and the refrigerant circulated by the sub compressor 9 thus converge to flow through the first water-refrigerant heat exchanger 2.

With the plate heat exchanger used as the water-refrigerant heat exchanger (see FIG. 2), the flow channel of water and the flow channel of refrigerant usually have the same flow cross-sectional area, which often results in an increase in the flow speed on the refrigerant side. This may easily cause a poor heat transfer performance on the refrigerant side. In the present embodiment, however, the total amount of refrigerant from the main compressor 1 and the sub compressor 9 flows through the first water-refrigerant heat exchanger 2, thereby accelerating the flow speed of refrigerant in the first water-refrigerant heat exchanger 2. This allows for an improvement in the heat transfer performance of the first water-refrigerant heat exchanger 2.

With further reference to the plate heat exchanger, the flow speed is reduced especially with a subcooled liquid, which results in a deterioration in the heat transfer property. This does not allow for a large degree of subcooling. With the present embodiment, however, the internal heat exchanger is thus used to allow for a large degree of subcooling. Hence, a highly efficient refrigeration cycle operation can be performed with a large degree of subcooling if a plate heat exchanger is employed.

A description is now given of when the sub radiation means 11 is used as an antifreeze heater with reference to FIG. 7 and FIG. 8.

When the outside air drops below zero, frost occurs on the air heat exchanger 5 during a water heating operation. In order to remove such frost, intermittent defrosting may be performed. A problem is, however, that resultant drain water or melting frost by defrosting may freeze and develop at a bottom portion of the air heat exchanger 5 or in a drain pan 21, which may cause damage on the water heating apparatus. FIG. 7 shows the sub radiation means 11 which is designed to avoid such damage. The sub radiation means 11 of FIG. 7 uses part of a heat transfer pipe disposed at a bottom portion of the air heat exchanger 5. Alternatively, however, a special pipe closely attached to the drain pan 21 disposed below the air heat exchanger 5 may be used.

An antifreeze operation by the second refrigeration cycle of a refrigerant circuit shown in FIG. 7 is basically the same as the operation of the refrigerant circuit described with reference to FIG. 4 as shown in the P-h diagram of FIG. 8.

While the sub compressor 9 is in operation, heat is recovered by the inner heat exchanger 3, and the high temperature, high pressure gas refrigerant discharged from the sub compressor 9 enters an antifreeze heater 24 as the sub radiation means 11 to cause melting frost and re-frozen ice to be melted. This antifreeze operation may be continued during a water heating operation, or carried out only for a predetermined period of time after the defrost operation is finished.

Heat pump apparatuses designed for use in cold climates are generally equipped with electric heaters as antifreeze heaters. With the present embodiment, however, an amount of heat absorbed from the outside air is increased because of an increase in the enthalpy difference at the evaporator in addition to heat from the electricity input of the sub compressor 9. This can obtain condensation heat in amounts greater than that which would be obtained only from the electricity input, and thereby allows for a highly efficient antifreeze operation.

As described above, according to the heat pump water heating apparatus of this embodiment, the enthalpy difference at the evaporator is thus increased by heat recovery by the sub compressor 9 and the internal heat exchanger 3. This can result in a large heating capacity which is equal or more than the heating capacity that would be obtained by the electricity input of the sub compressor 9, and also result in an increase in the amount of heat absorbed from the outside air. This allows for a water heating operation with a COP that is higher than the COP of an electric heater increasing the heating capacity.

In addition to the above, the total amount of refrigerant from the first compressor 1 and the sub compressor 9 enters the first water-refrigerant heat exchanger 2, thereby thus accelerating the flow speed of refrigerant moving through the first water-refrigerant heat exchanger 2. This improves the refrigerant side heat transfer performance inside the first water-refrigerant heat exchanger 2. This is especially effective with a plate heat exchanger as the first water-refrigerant heat exchanger 2.

In addition to the above, the antifreeze heater 24 as the sub radiation means 11 is thus disposed on the second refrigeration cycle side as an alternative to an electric heater for heating water and for preventing the air heat exchanger 5 from freezing. This allows the COP of the refrigeration cycle to be improved by the heat recovery operation of the internal heat exchanger 3, thereby allowing for a water heating operation with a higher efficiency than that of a water heating operation using an electric heater.

With further reference to the heat pump water heating apparatus of this embodiment, the second water-refrigerant heat exchanger 23 is arranged between the sub compressor 9 and the junction expansion valve 12. This is designed so that the first refrigeration cycle and the second refrigeration cycle have different condensation temperatures in order to heat water in two stages. This allows for a highly efficient and reliable water heating operation in response to a demand for high-temperature water.

With further reference to the foregoing, the sub radiation means 11 provided between the sub compressor 9 and the junction expansion valve 12 in the second refrigeration cycle is solely connected to the second water-refrigerant heat exchanger 23 or the antifreeze heater 24. Alternatively, however, a plurality of sub radiation means 11 may be provided in a parallel arrangement. With this case, a sub radiation means switching unit (a radiation means switching unit S) may be provided to switch between the plurality of radiation means 11 so that the refrigerant flowing through the second refrigeration cycle can flow through one of them.

Further to the foregoing, a description has been given of the heat pump water heating apparatus for supplying heated water (hot water) to the hot water tank 7 as an example of the heat pump apparatus. Alternatively, however, the heat pump apparatus may be a heat pump air heating apparatus for supplying heated water to a radiator or the like.

Further to the foregoing, a description has been given of water as an example of a heating medium for heat exchange with a refrigerant in the first water-refrigerant heat exchanger 2 and the second water-refrigerant heat exchanger 23. Alternatively, however, any fluid other than water may also be used as a heating medium for heat exchange with a refrigerant in the first water-refrigerant heat exchanger 2 and the second water-refrigerant heat exchanger 23. For example, an air heat exchanger for exchanging heat between air and a refrigerant may be used instead of the first water-refrigerant heat exchanger 2 and/or the second water-refrigerant heat exchanger 23. The use of an air heat exchanger is particularly effective with a device requiring high-temperature air such as a blow dryer.

REFERENCE SIGNS LIST

1 main compressor
2 first water-refrigerant heat exchanger
3 internal heat exchanger
4 motorized expansion valve
5 air heat exchanger
6 fan
7 hot water tank
8 flow-divider expansion valve
9 sub compressor
10 check valve
11 sub radiation means
12 junction expansion valve
13 pressure sensor
14 pressure sensor
15 pressure sensor
16 pressure sensor
17 temperature sensor
18 temperature sensor
19 temperature sensor
20 temperature sensor
21 drain pan
22 suction pipe
23 second water-refrigerant heat exchanger
24 antifreeze heater

The invention claimed is:

1. A heat pump apparatus comprising:

a first refrigeration cycle configured to connect in series a first compressor, a first heat exchanger, an internal heat exchanger, a first pressure reducing device, and an evaporator, a second refrigeration cycle diverging from the first refrigeration cycle at a diverging point between the first heat exchanger and the first pressure reducing device, and joining the first refrigeration cycle at a meeting point between the first compressor and the first heat exchanger, the second refrigeration cycle connects in series a second pressure reducing device, the internal heat exchanger, a second compressor, a second heat exchanger, and a third pressure reducing device, between the diverging point and the meeting point, the second refrigeration cycle further comprises a pipe disposed in a vicinity of a lower end of the evaporator between the second compressor and the third pressure reducing device, and the second heat exchanger and the pipe are arranged in parallel between the second compressor and the third pressure reducing device, and a controller that adjusts an opening of the third pressure reducing device so that a condensation pressure of the second heat exchanger is higher than a condensation pressure of the first heat exchanger, wherein the second heat exchanger is arranged so that heat is exchanged between a fluid and a refrigerant flowing through the first refrigeration cycle in the first heat exchanger, and then heat is exchanged between the fluid and a refrigerant flowing through the second refrigeration cycle in the second heat exchanger, and wherein the second refrigeration cycle further comprises a radiator switching device for switching between the second heat exchanger and the pipe to allow the refrigerant flowing through the second refrigeration circuit to flow through one of the second heat exchanger and the pipe.

2. The heat pump apparatus according to claim 1, wherein the controller controls the second compressor so that an evaporation pressure of the second refrigeration cycle is higher than an evaporation pressure of the first refrigeration cycle.

3. The heat pump apparatus according to claim 1, wherein the first heat exchanger is a water-refrigerant heat exchanger for exchanging heat between water and the refrigerant flowing through the first refrigeration cycle, and wherein the second heat exchanger is a water-refrigerant heat exchanger for exchanging heat between water and the refrigerant flowing through the second refrigeration cycle.

4. The heat pump apparatus according to claim 3, wherein at least one of the first heat exchanger and the second heat exchanger is a plate heat exchanger.

* * * * *